US010233629B2

(12) United States Patent
Cole et al.

(10) Patent No.: US 10,233,629 B2
(45) Date of Patent: Mar. 19, 2019

(54) CABLE MOVEMENT INDICATOR FOR PLUMBING TOOLS

(71) Applicant: Ridge Tool Company, Elyria, OH (US)

(72) Inventors: Alex M. Cole, Parma, OH (US); Michael J. Rutkowski, Locust Grove, VA (US); Jeffrey Szucs, Akron, OH (US); Jon R. Dunkin, Elyria, OH (US)

(73) Assignee: RIDGE TOOL COMPANY, Elyria, OH (US)

( * ) Notice: Subject to any disclaimer, the term of this patent is extended or adjusted under 35 U.S.C. 154(b) by 323 days.

(21) Appl. No.: 15/273,513

(22) Filed: Sep. 22, 2016

(65) Prior Publication Data

US 2018/0080212 A1 Mar. 22, 2018

(51) Int. Cl.

| | |
|---|---|
| ***E03F 9/00*** | (2006.01) |
| ***E03C 1/302*** | (2006.01) |
| ***B08B 9/04*** | (2006.01) |
| ***B08B 9/043*** | (2006.01) |
| ***B08B 9/045*** | (2006.01) |

(52) U.S. Cl.

CPC ..... *E03F 9/005* (2013.01); *B08B 9/04* (2013.01); *B08B 9/043* (2013.01); *B08B 9/045* (2013.01); *E03C 1/302* (2013.01); *E03F 9/002* (2013.01)

(58) Field of Classification Search

CPC ..... E03C 1/302; E03F 9/002; E03F 9/005; B08B 9/02; B08B 9/027; B08B 9/04; B08B 9/043; B08B 9/0436; B08B 9/045

USPC ..... 15/104.33

See application file for complete search history.

(56) References Cited

U.S. PATENT DOCUMENTS

| | | | |
|---|---|---|---|
| 3,078,486 | A | 2/1963 | Casto et al. |
| 5,009,242 | A | 4/1991 | Prange |
| 8,046,862 | B2 | 11/2011 | Eisermann et al. |
| 8,176,593 | B2 | 5/2012 | Gress et al. |
| 8,413,347 | B2 | 4/2013 | Gress et al. |
| 2008/0148503 | A1 | 6/2008 | Babb et al. |

FOREIGN PATENT DOCUMENTS

| | | |
|---|---|---|
| WO | 2008079702 | 7/2008 |

*Primary Examiner* — Mark Spisich

(74) *Attorney, Agent, or Firm* — Mark E. Bandy; Rankin, Hill & Clark LLP

(57) ABSTRACT

Various assemblies for indicating movement and direction of drain cleaning cables used in plumbing tools are described. Generally, the plumbing tools include a cam that is in operable engagement with a guide tube. Upon axial movement of cable relative to the tool, the cam causes reciprocal movement of an indicator. The plumbing tools can additionally include switches and/or electronics in communication with the indicator to thereby provide information or processing of tool operation.

19 Claims, 18 Drawing Sheets

CABLE MOVEMENT INDICATOR FOR PLUMBING TOOLS

FIELD

The present subject matter relates to indicators for use in a wide array of plumbing tools. In particular, the present subject matter is directed to indicators or related assemblies for providing information to an operator concerning cable movement in drum type plumbing tools.

BACKGROUND

A variety of indicators are used in plumbing tools to provide indication of movement of a drain cleaning cable. Such indicators are particularly useful for drum type machines. A typical cable movement indicator provides an operator with feedback of whether cable is being removed from (advanced) or added to the drum (retrieved). When using a mechanical feed to advance or retrieve cable, an operator cannot easily determine cable movement due to the rotation of the cable and drum. Also, while using a mechanical cable feed an operator is typically not aware of whether the correct amount of force is being applied using the mechanical feed to advance or retrieve cable.

By providing indication of cable movement, an operator could assess whether cable is being extended or retracted, which may be difficult to observe particularly if the cable is inserted within a drain line for example. Providing indication of cable movement would also allow the operator to confirm whether the feed mechanism is working properly and that a proper amount of force is being applied. Although indicators are known in the prior art, a need exists for improved indicators and related strategies for providing indication and/or feedback to an operator of cable movement, and particularly cable advancement and cable retrieval.

SUMMARY

The difficulties and drawbacks associated with previous approaches are addressed in the present subject matter as follows.

In one aspect, the present subject matter provides a plumbing tool comprising an outer housing and a rotatable drum at least partially supported by the housing. The drum defines a hollow interior adapted for retaining a drain cleaning cable. The outer housing and the drum generally define a center axis and a forward end of the tool. The tool also comprises a rotatable guide tube rotatably supported within the tool. The guide tube extends between the hollow interior of the drum and the forward end of the tool. The guide tube is adapted to receive a drain cleaning cable extending through the guide tube. The guide tube rotates relative to the drum upon axial movement of a drain cleaning cable extending through the guide tube relative to the drum. The tool also comprises a rotatable cam component in operable engagement with the guide tube such that upon rotation of the guide tube, the cam component undergoes axial reciprocal movement. The tool additionally comprises an indicator in operable communication with the cam component, wherein upon axial reciprocal movement of the cam component, the indicator also undergoes axial reciprocal movement and thereby provides indication of axial cable movement relative to the tool.

In another aspect, the present subject matter provides a plumbing tool comprising an outer housing and a rotatable drum at least partially supported by the housing. The drum defines a hollow interior adapted for retaining a drain cleaning cable. The outer housing and the drum generally define a center axis and a forward end of the tool. The tool additionally comprises a rotatable guide tube rotatably supported within the tool. The guide tube extends between the hollow interior of the drum and the forward end of the tool. The guide tube is adapted to receive a drain cleaning cable extending through the guide tube. The guide tube rotates relative to the drum upon axial movement of a drain cleaning cable extending through the guide tube. The tool also comprises a follower coupled to the drum. The follower defines a follower face. The tool also comprises a rotatable cam component in operable engagement with the guide tube such that upon rotation of the guide tube relative to the drum, the cam component rotates and undergoes axial reciprocal movement. The cam component is adjacent to the follower and the follower face contacts the cam component. The tool also comprises an indicator in operable communication with the cam component, wherein upon axial reciprocal movement of the cam component, the indicator also undergoes axial reciprocal movement and thereby provides indication of axial cable movement relative to the tool.

In still another aspect, the present subject matter provides a plumbing tool comprising an outer housing and a rotatable drum at least partially supported by the housing. The drum defines a hollow interior adapted for retaining a drain cleaning cable. The outer housing and the drum generally define a center axis and a forward end of the tool. The tool also comprises a rotatable guide tube rotatably supported within the tool. The guide tube extends between the hollow interior of the drum and the forward end of the tool. The guide tube is adapted to receive a drain cleaning cable extending through the guide tube. The guide tube rotates relative to the drum upon axial movement of a drain cleaning cable extending through the guide tube. The tool also comprises a follower coupled to the guide tube. The follower defines a follower face. The tool additionally comprises a rotatable cam component in operable engagement with the follower such that upon rotation of the follower relative to the drum, the cam component undergoes axial reciprocal movement. The cam component is adjacent to the follower and the follower face contacts the cam component. The tool additionally comprises an indicator in operable communication with the cam component, wherein upon axial reciprocal movement of the cam component, the indicator also undergoes axial reciprocal movement and thereby provides indication of axial cable movement relative to the tool.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
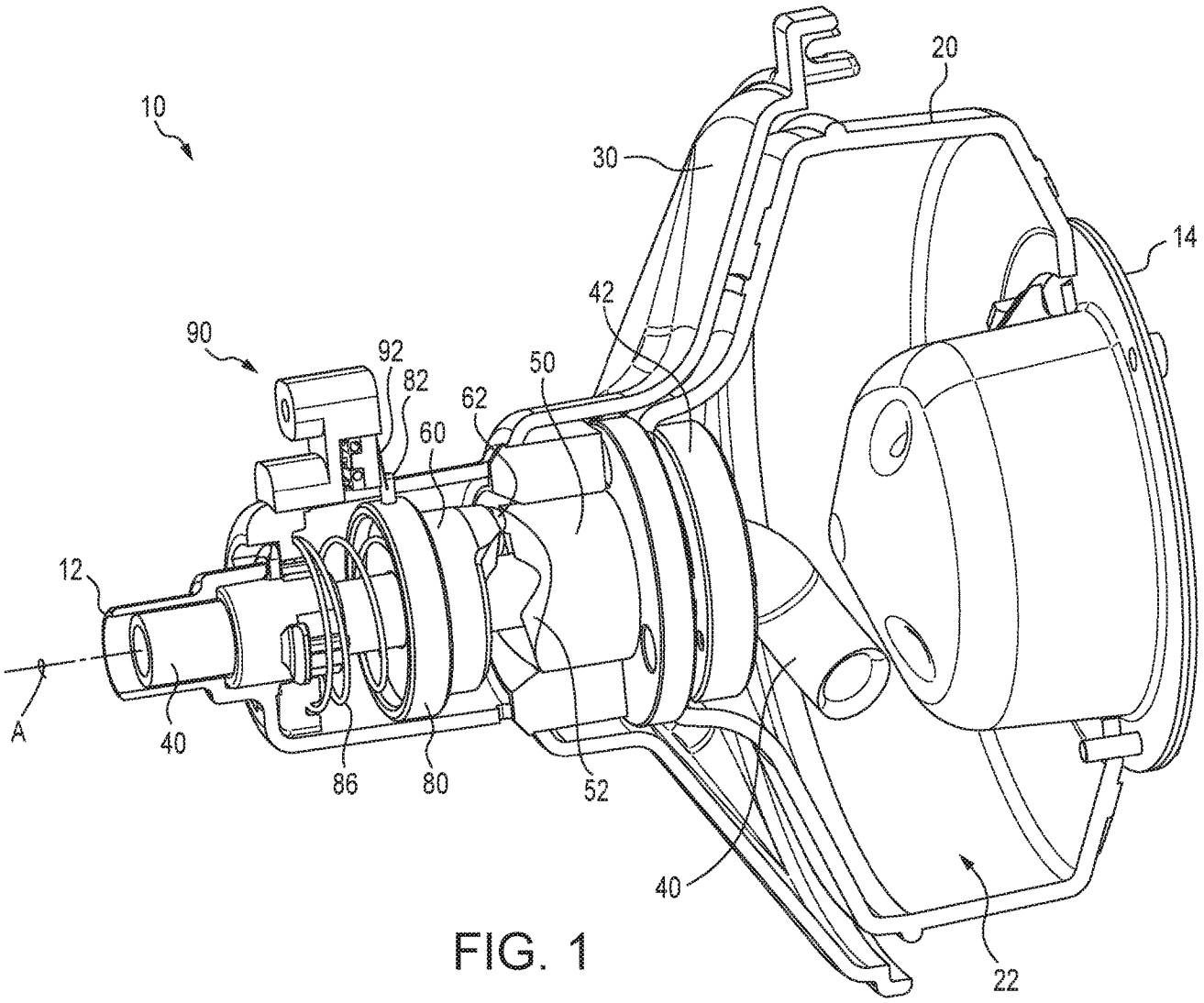
FIG. 1 is a perspective partial cut-away view of an embodiment of a drum type plumbing tool having a cable movement indicator assembly in accordance with the present subject matter.
Figure 2:
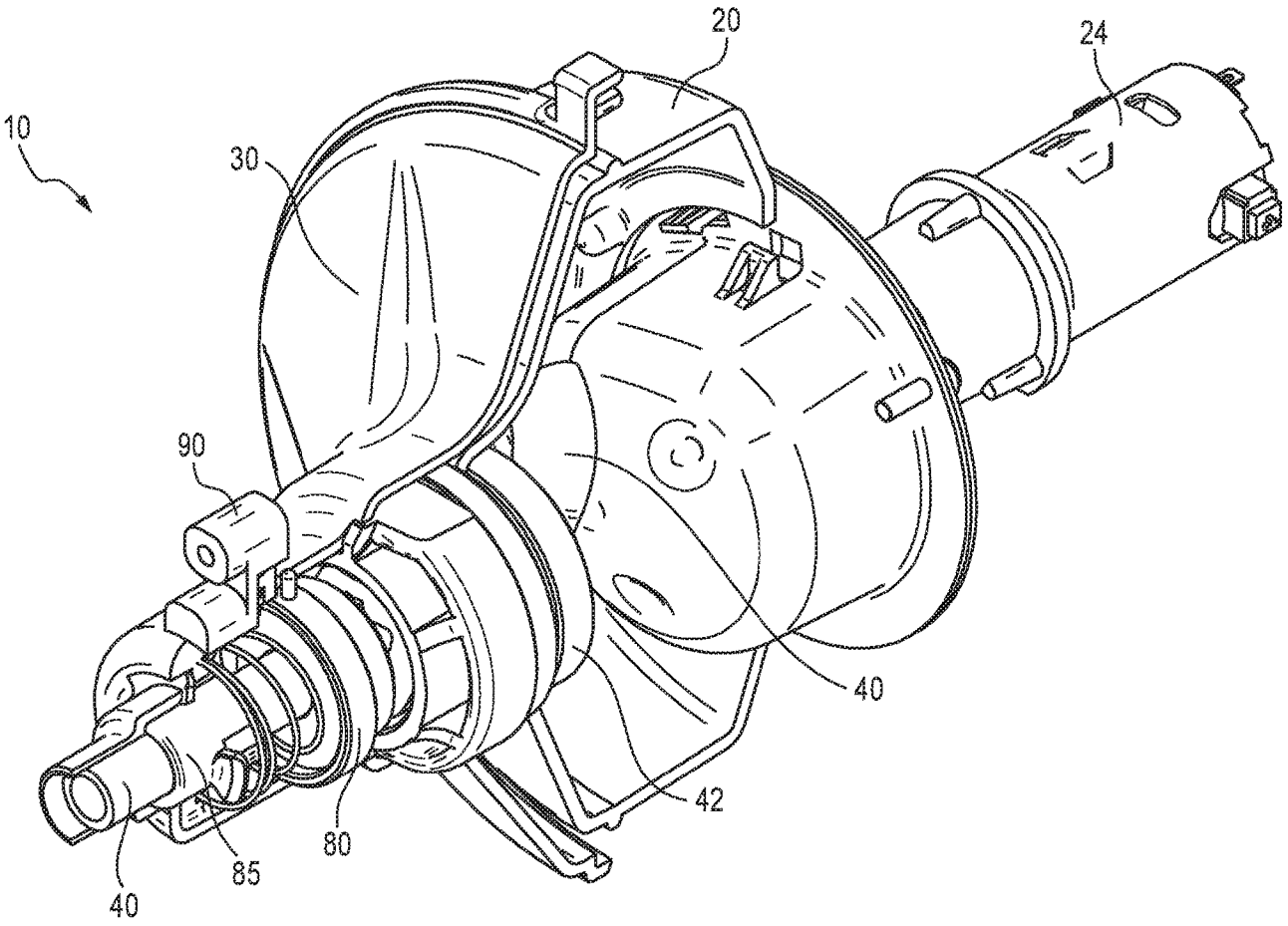
FIGS. 2-4 are additional views of the plumbing tool depicted in FIG. 1 in which a cam component is depicted in a trough position.
Figure 3:
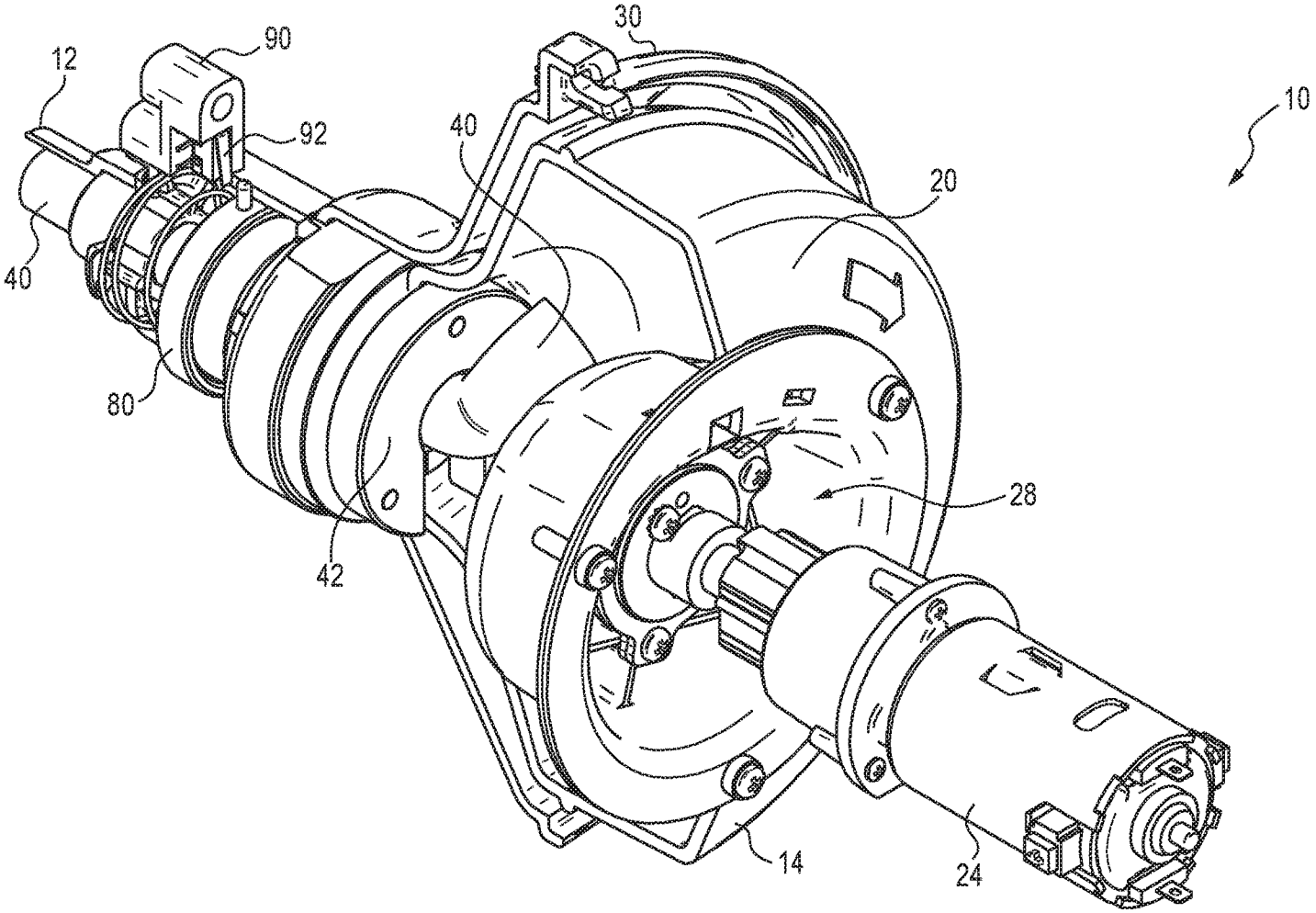

The present subject matter provides a drum type plumbing tool comprising an indicator assembly which utilizes a cam mechanism which is driven by a rotating guide tube within a drum. The indicator assembly also utilizes a cam follower engaged with the drum. The guide tube will only rotate within the drum as cable is advanced out of, or retrieved into, the drum. The drum rotates continuously when cable is stationary or as cable is moving. The subject matter also provides a drum type plumbing tool comprising an indicator assembly which utilizes a cam mechanism that is driven by the rotating drum. The indicator assembly also utilizes a cam follower engaged with the guide tube. Similarly, the guide tube will only rotate within the drum as cable is advanced out of, or retrieved into, the drum. The drum rotates continuously when cable is stationary or as cable is moving.

In one embodiment, the cam is engaged with the guide tube so that the cam rotates with the guide tube. An indicator is adjacent the cam. The indicator is free to move along the axis of rotation of the drum. The follower is engaged with the drum. One or more springs are retained to apply force to the backside of the indicator and cam in order to maintain contact between the cam and follower. As the guide tube rotates within the drum, the cam rotates about the surface of the follower, thereby resulting in linear motion of the indicator. Attached to the indicator is a member which moves with the indicator, which activates a switch. This switch can operate a variety of electronics to provide feedback to the operator that the cable is moving.

In another embodiment the cam is affixed to the rotating drum. A follower is coupled with a guide tube so the two rotate together. The follower is free to move along an axis of the guide tube without rotating about the guide tube. An indicator is constrained from rotating. This indicator is able to move along the axis of the guide tube as does the follower. Both of these components are backed by one or more springs to maintain contact between the follower and the cam. As the guide tube rotates within the drum, the guide tube rotates the follower about the surface of the cam, thereby creating linear motion along the axis of the guide tube. This linear motion of the follower is translated to the indicator which actuates a switch. This switch can operate a variety of electronics to provide feedback to the operator that the cable is moving.

Each embodiment assembly produces linear motion and more specifically reciprocal axial motion of an indicator from rotary cam-based assemblies. One embodiment utilizes a cam coupled to a rotating guide tube. Another embodiment utilizes a cam coupled to a rotating drum. Resulting linear motion of an indicator is used to actuate electronics to provide indication of cable movement.

FIGS. 1-8 illustrate an embodiment of a plumbing tool having a cable movement indicator in accordance with the present subject matter. In this embodiment, the cable movement indicator includes a cam coupled to a rotating guide tube. FIGS. 9-16 illustrate another embodiment of a plumbing tool having a cable movement indicator in accordance with the present subject matter. In this embodiment, the cable movement indicator includes a cam affixed to a rotating drum.

Figure 4:
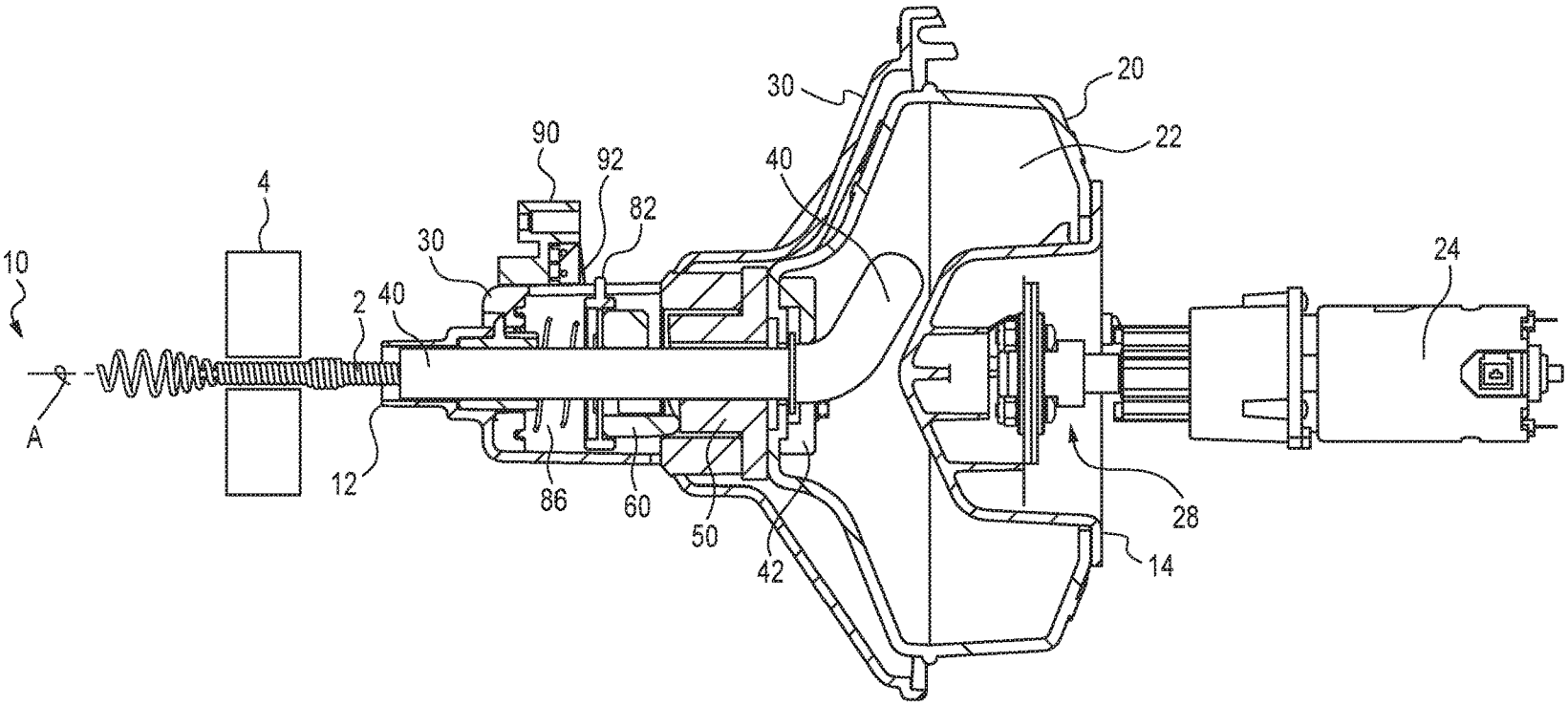

Specifically, FIGS. 1-8 illustrate an embodiment of a plumbing tool 10 with a cable movement indicator assembly in accordance with the present subject matter. The tool 10 comprises a rotatable drum 20 which can be in the form of a single drum component or include a plurality of drum components. The rotatable drum 20 defines a generally hollow interior 22 in which a drain cleaning cable or "snake" 2 is retained or otherwise stored. For clarity purposes, only a portion of the cable 2 which is external to the tool 10 is shown in FIG. 4. The tool 10 also comprises an outer housing 30. The housing 30 and the drum 20 generally define a center axis A, a forward end 12 of the tool 10, and a rearward face 14 of the tool. The face 14 is generally oppositely directed from the forward end 12. The drum 20 and other components described herein are rotatable about the axis A. The drum 20 is typically at least partially supported by the housing 30.

The tool 10 also comprises a drive fixture 28 best shown in FIGS. 3, 4, 6, 7, and 8 for engagement with a rotary power source such as for example a powered drive 24. The drive fixture 28 is typically provided or otherwise accessible along the rearward face 14. The tool 10 can be provided with a rotary power source, or be provided without such and subsequently used by engagement with an external rotary power source. It is contemplated that a manual drive could also be used to operate the tool 10.

The tool 10 further comprises a rotatable guide tube 40 which generally extends between the hollow interior 22 defined by the drum 20, and the forward end 12 of the tool. The guide tube 40 is rotatably supported within the tool 10 such as by a guide tube support 42 and portions of the drum 20 and housing 30. One or more bearings 85 can be used to rotatably support the guide tube 40. As shown in the referenced figures, the guide tube 40 is typically in the form of a hollow member that includes a cylindrical portion disposed proximate the forward end 12 of the tool 10, and an angled portion that extends within the hollow interior 22 of the drum 20. As will be understood, the drain cleaning cable 2 extends through the guide tube 40. Upon rotation of the drum 20 and cable 2, and upon activation of a cable feed assembly, cable is either extended from the drum 20, or retracted into the drum 20. A cable feed assembly 4 is schematically depicted in FIG. 4. As will be understood, actuation of the cable feed assembly 4 translates rotary motion of cable 2 about axis A, to linear axial motion of cable 2 along axis A. A variety of cable feed assemblies are known in the art such as those described in US 2016/0175899; U.S. Pat. Nos. 6,158,076, 6,412,136; and 7,367,077 for example, all assigned to Applicant. The guide tube 40 rotates about axis A at the same rotational speed as the drum 20 when the cable is not being extended or retracted. Linear or axial movement of the cable results in rotation of the guide tube 40 at a different rate of rotation than that of the drum 20.

The tool 10 also comprises a rotatable cam component 60. The cam component 60 is engaged with the guide tube 40 such that upon rotation of the guide tube 40 about axis A, the cam component 60 also rotates about the axis A. In the embodiment in the referenced figures, the cam component 60 defines a keyway 61 illustrated in FIG. 8 which is sized to fittingly receive a key 41 defined on the guide tube 40. Upon insertion of the key 41 within the keyway 61, the cam 60 is rotatably engaged with the guide tube 40. The cam component 60 defines a cam member 62 at which a follower face 52 of a cam follower 50 generally contacts. The cam follower 50 is disposed adjacent to the cam component 60. The cam follower 50 is engaged with the drum 20 by fasteners 53. Rotation of the cam member 60 relative to the drum 20, occurring as a result of drain cleaning cable being extended or retracted from the tool 10, results in axial movement of the cam member 62 and cam 60. The follower face 52 includes (i) one or more projections, lobes, or crests, and (ii) one or more depressions, valleys, or troughs, which upon rotation of the cam 60, cause the cam 60 and member 62 to move back and forth along axis A in a reciprocating manner. The present subject matter includes providing projections and/or depressions on either contacting face of the cam or follower, and also includes providing such on both faces of the cam and follower.

The tool 10 also comprises an indicator 80 having an indicator member 82 which is engaged with or in operable communication with the cam member 60 such that the indicator 80 undergoes axial movement corresponding with axial movement of the cam 60. In certain versions, the tool can utilize an indicator assembly which is in operable communication with the follower component 50 such that upon rotation of the follower component 50, the indicator 80 undergoes axial reciprocal movement. Other variations are encompassed by the present subject matter.

The tool 10 further includes one or more biasing members 86 that promote contact and/or operable engagement between the cam member 62 and the follower face 52. As will be appreciated, the biasing member(s) 86 can be in the form of springs such as coil compression spring(s) that urge the cam 60 toward the follower face 52 along axis A. One or more retaining members can be used to retain the biasing member(s) 86 within the tool housing 30. The housing 30 can include a recessed region or pocket to retain the biasing member 86.

Figure 8:
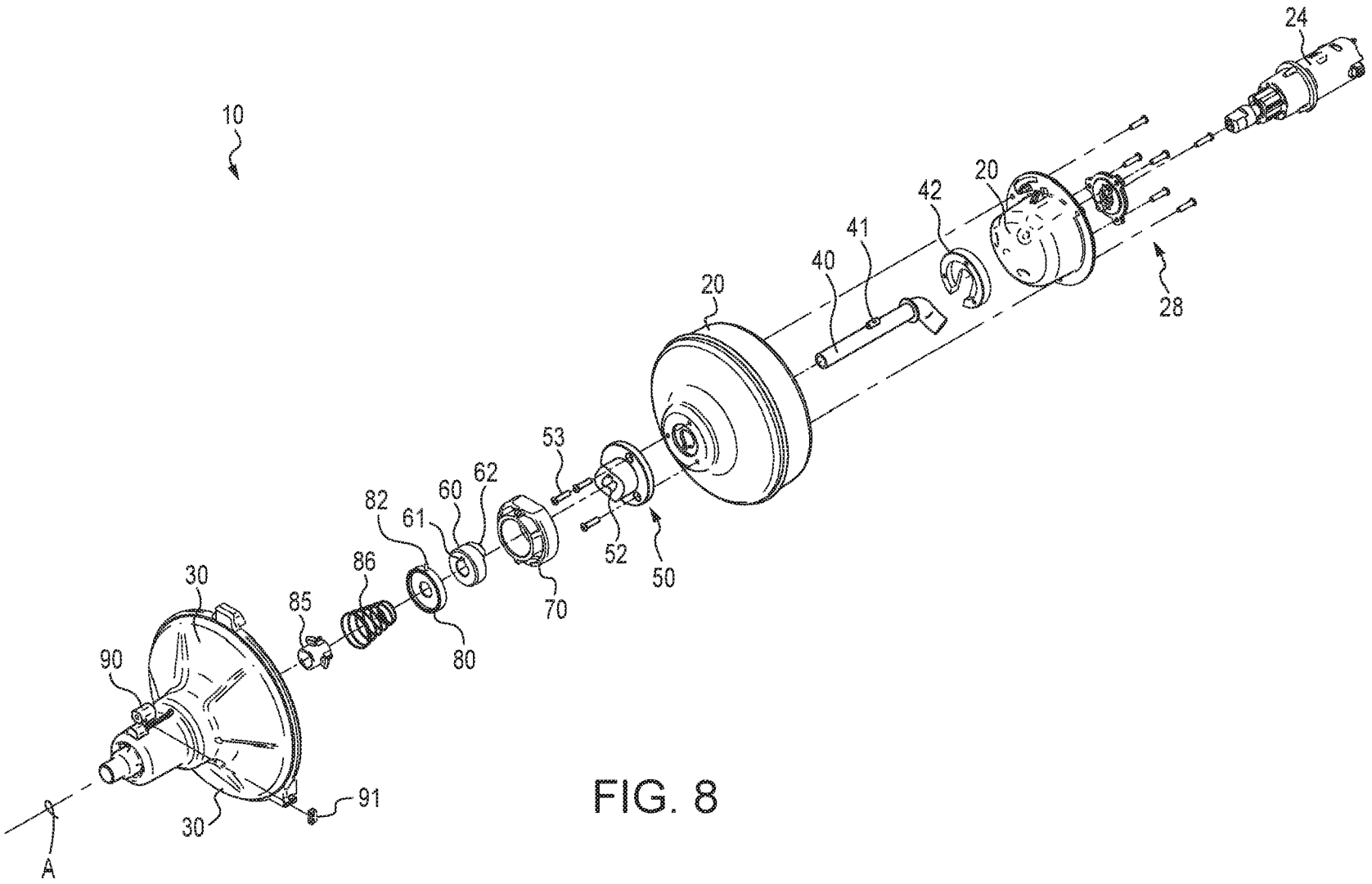
FIG. 8 is an exploded assembly view of the plumbing tool of FIG. 1.
Figure 9:
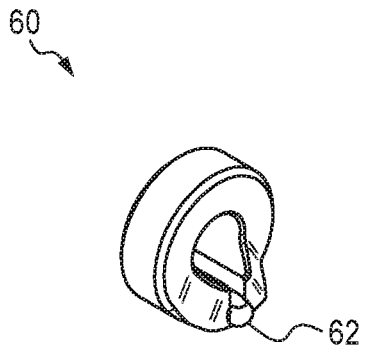
FIG. 9 is a perspective view of an embodiment of a cam component used in the plumbing tool of FIGS. 1-8.
Figure 10:
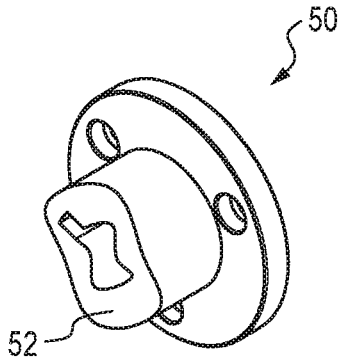
FIG. 10 is a perspective view of an embodiment of a cam follower used in the plumbing tool of FIGS. 1-8.

The tool 10 can optionally include one or more switches 90 or switch assemblies that are in operable engagement or communication with the indicator 80 and more particularly the indicator member 82. In many versions, the switch 90 is mounted on the outer housing 30 which is generally stationary. The switch assembly 90 typically includes one or more electrical switches, contacts, and conductors in an enclosure or housing. It will be appreciated that although the switch 90 is depicted in the referenced figures by its housing, that housing includes the one or more components that perform the electrical switching function. A representative switch for enclosure within the switch housing is depicted in FIG. 8 as item 91. The switch 90 is in operable engagement with the indicator 80 such that reciprocal axial movement of the indicator 80 or cam 60, causes repeated actuation of the switch 90 such as by contact between a switch actuator 92 and the indicator member 82. As will be appreciated, the switch 90 is in electrical communication with electronics that monitor the frequency and/or other characteristics of switch actuation. The switch 90 can include signal means to provide an electrical signal that includes information concerning switch actuation.

A representative operation of the tool 10 is as follows. Upon operation of the powered drive 24, the drum 20 of the tool 10 is rotated about axis A. Rotation of the drum 20 imparts corresponding motion of cable 2 wound and retained within the interior 22 of the drum 20, and for cable disposed along axis A, rotation of that portion of cable about its longitudinal axis, which generally coincides with axis A.

Upon activation of the cable feed assembly, rotation of the cable about its axis is translated to axial movement of the cable along its axis. It is this axial movement of the cable, i.e., advancement from the end 12 of the tool, or retraction/retrieval into the drum 20, that causes rotation of the guide tube 40 relative to the drum 20.

Figure 5:
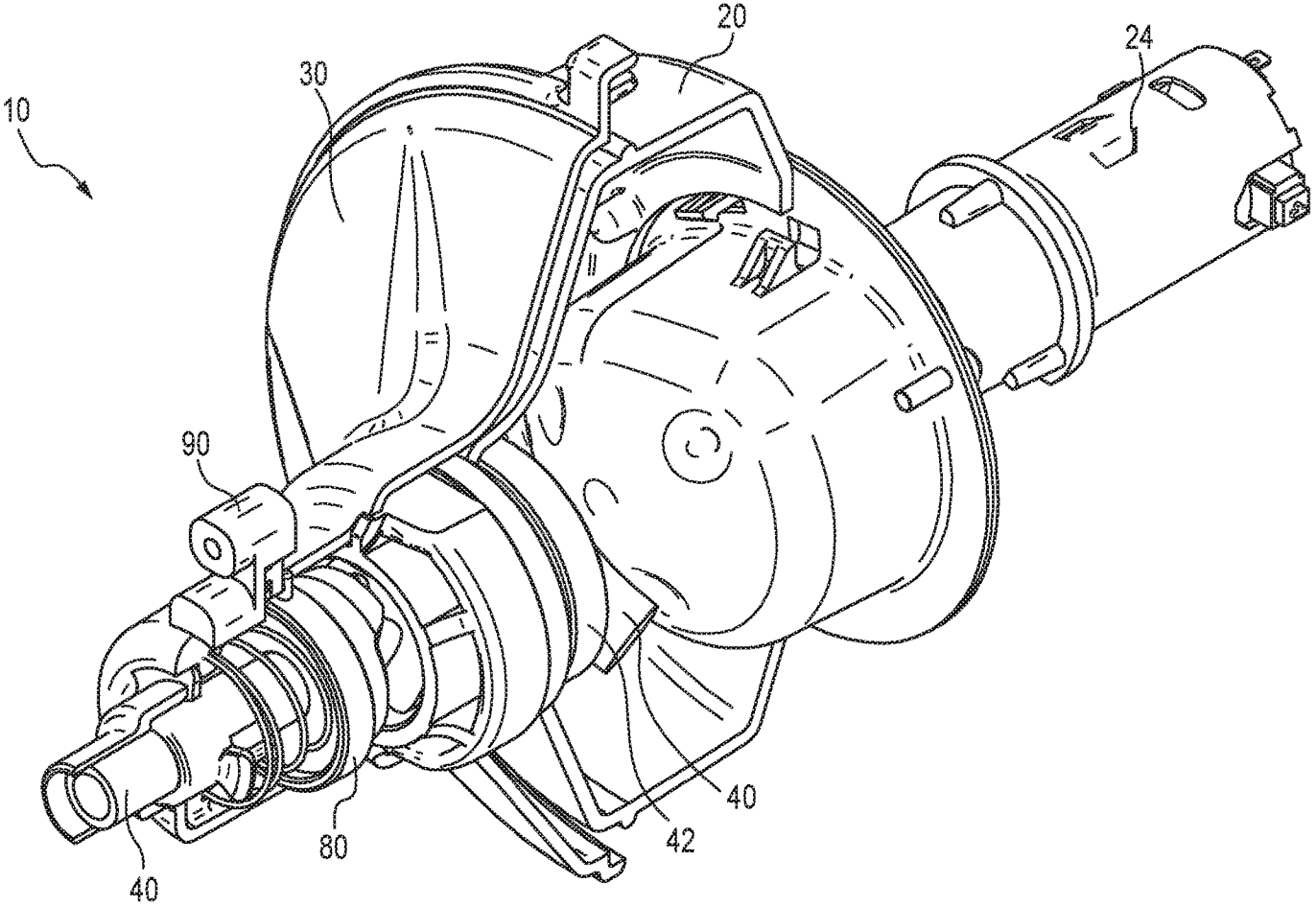
FIGS. 5-7 are additional views of the plumbing tool depicted in FIG. 1 in which the cam component is in a crest position.
Figure 6:
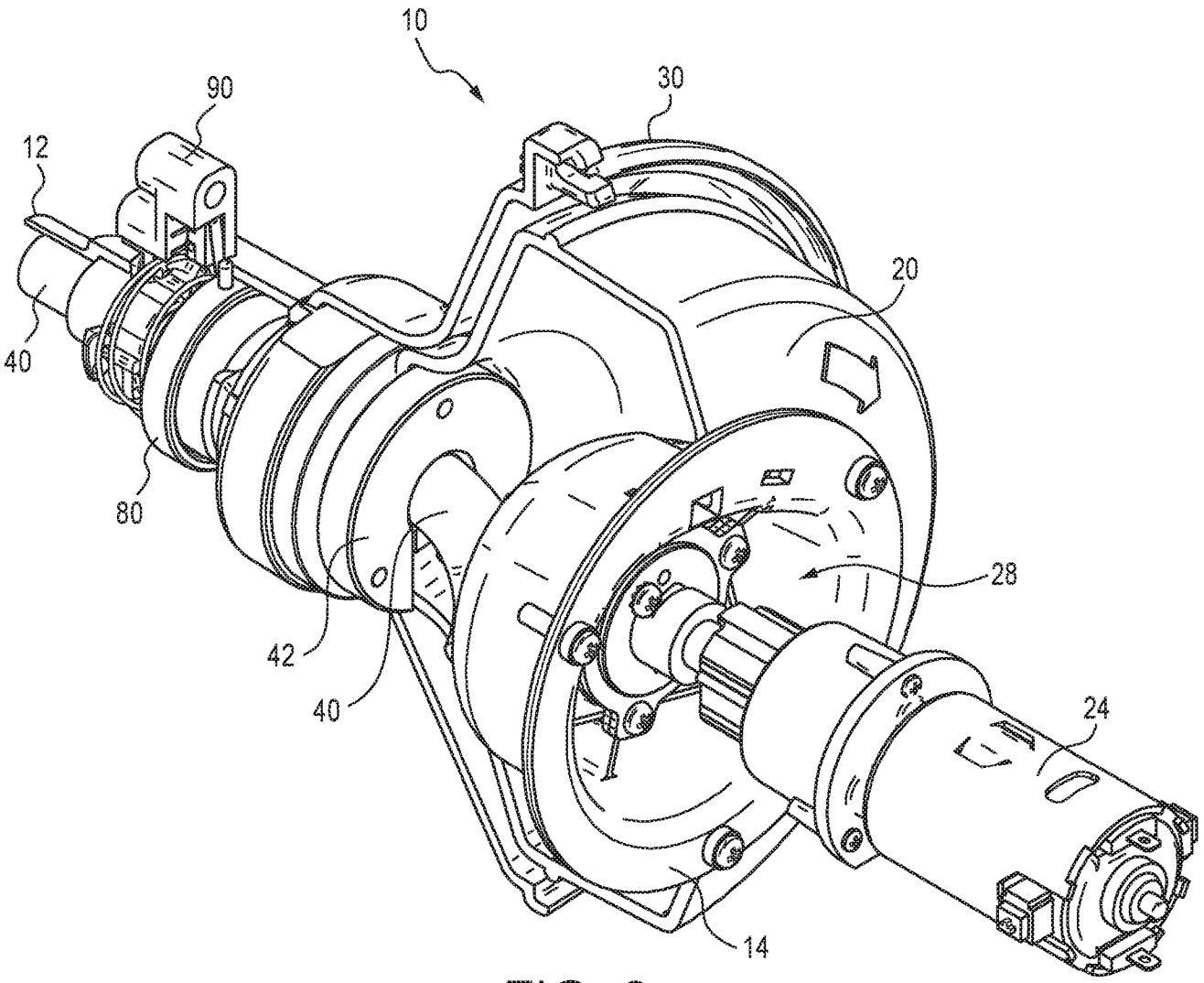
Figure 7:
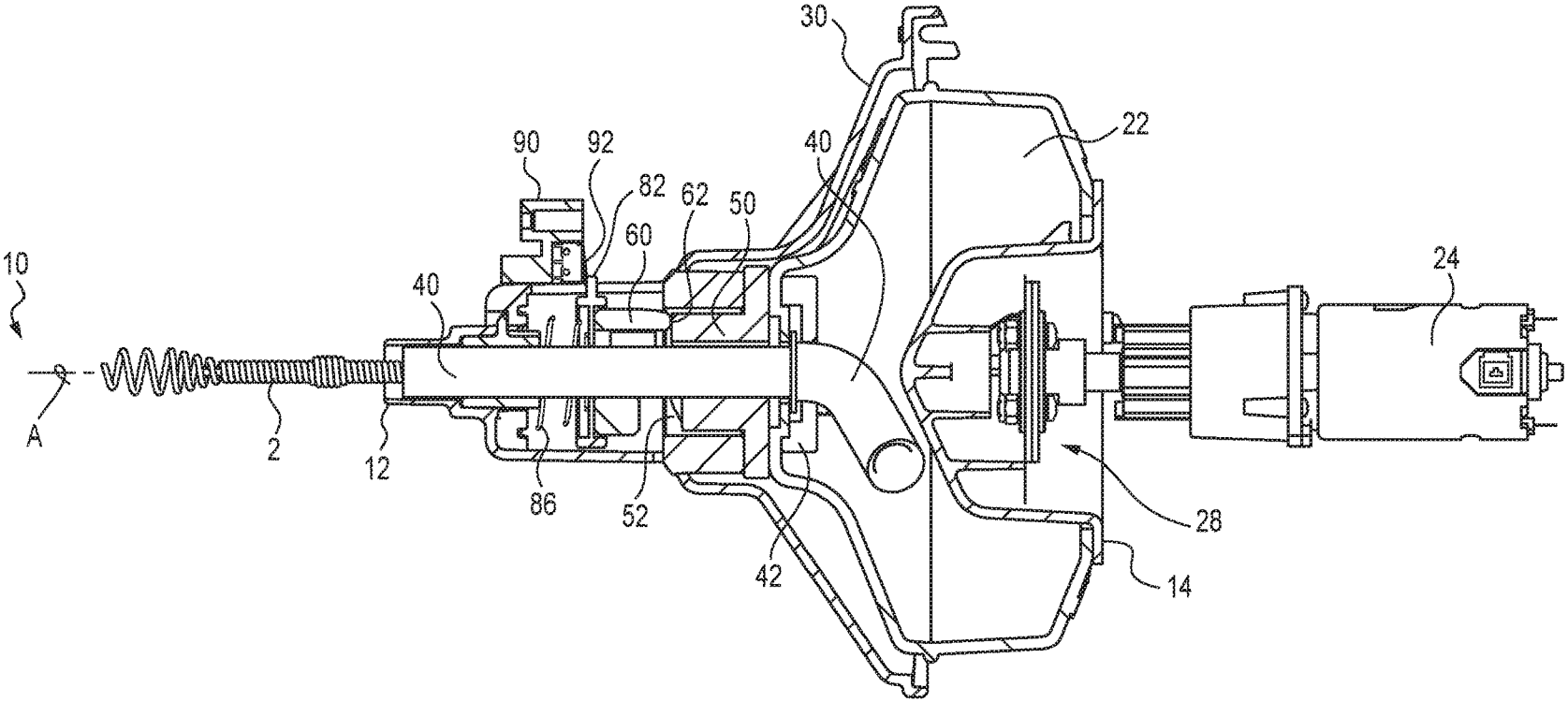

Rotary motion of the guide tube 40 about axis A is transferred to the cam 60 as a result of coupling between the guide tube 40 and the cam 60, e.g., key 41 and keyway 61. Rotation of the cam 60 relative to the drum 20 is translated to reciprocal axial movement of the cam 60 and indicator 80 due to contact between the cam member 62 and the follower face 52. FIGS. 5-7 depict a state at which the cam member 62 is at a crest position on a projection defined on the follower face 52. That crest position corresponds to full or maximum contact between the switch actuator 92 and the indicator member 82 as depicted in FIG. 7. As will be appreciated, such contact results in closure of the switch 90 which in turn can provide information or signal(s) to processing electronics. The present subject matter includes other configurations between the switch and the cam.

Figure 11:
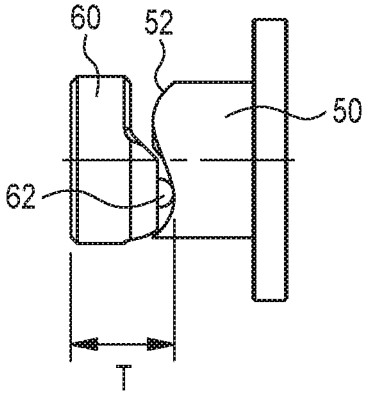
FIG. 11 is a side view showing contact between the cam and follower of FIGS. 9-10 and the cam located in a trough of the follower.
Figure 12:
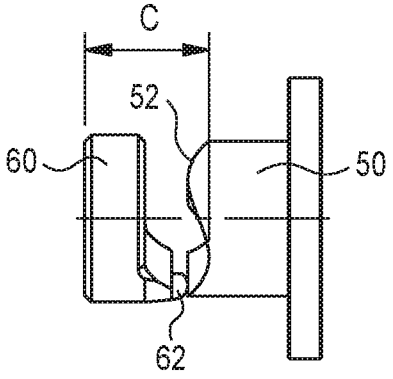
FIG. 12 is a side view showing contact between the cam and follower of FIGS. 9-10 and the cam located on a crest of the follower.
Figure 13:
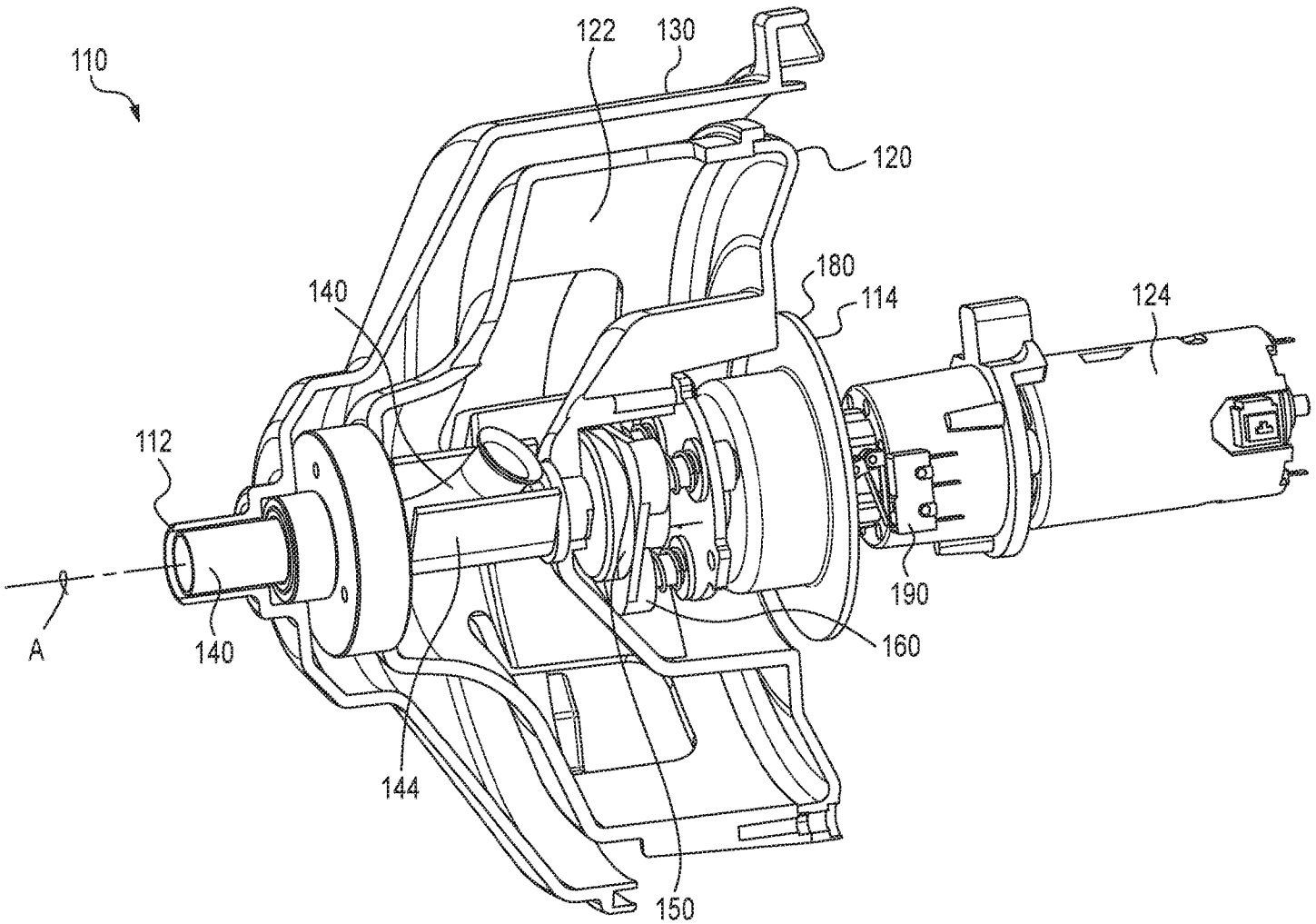
FIG. 13 is a perspective partial cut-away view of another embodiment of a drum type plumbing tool having a cable movement indicator assembly in accordance with the present subject matter.
Figure 14:
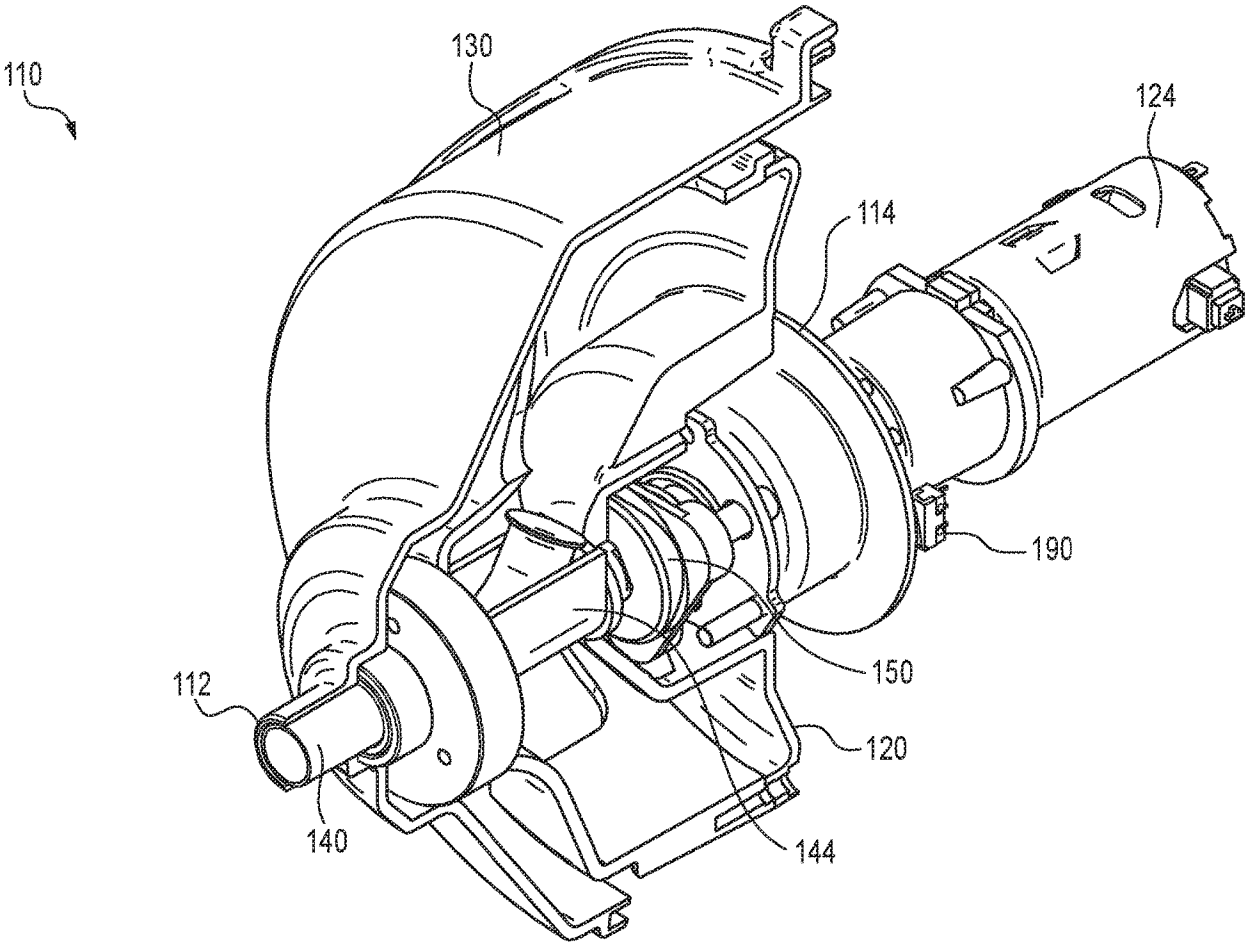
FIGS. 14-16 are additional views of the plumbing tool depicted in FIG. 13 in which a cam component is shown in a trough position.
Figure 15:
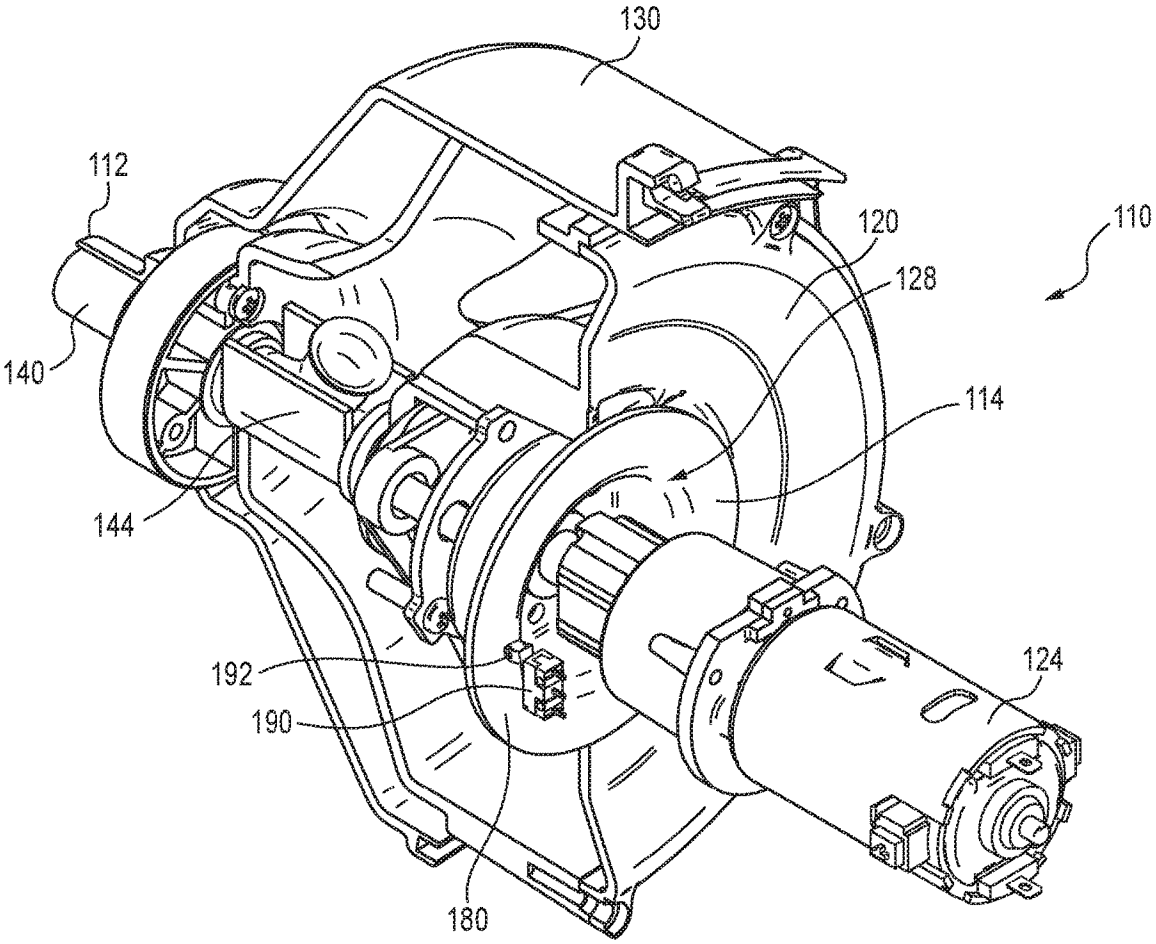
Figure 16:
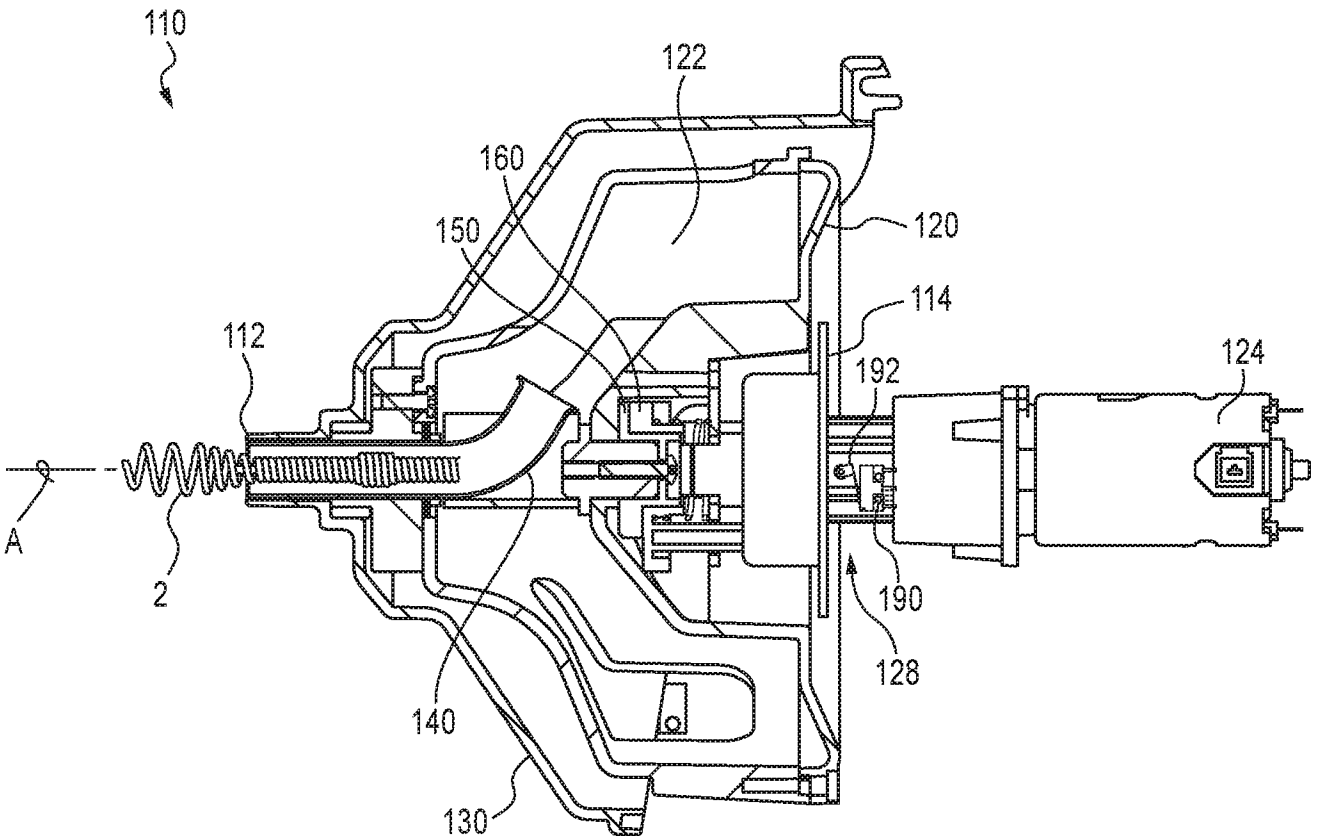

FIGS. 9-12 illustrate additional aspects of the cam component 60, the cam follower 50, and their engagement. Relative angular displacement of one component to another is translated to reciprocating linear movement of the cam component. FIG. 11 depicts a state in which the cam member 62 is disposed in a trough or valley defined along the follower face 52 and characterized by position T. FIG. 12 depicts a state in which the cam member 62 is disposed on a crest or peak defined along the follower face 52 and characterized by position C. As will be understood, upon relative angular displacement of the cam 60 with respect to the follower 50, the cam 60 undergoes reciprocal linear movement between positions T and C.

Specifically, FIGS. 13-20 illustrate another embodiment of a plumbing tool 110 with a cable movement indicator assembly in accordance with the present subject matter. The tool 110 comprises a rotatable drum 120 which can be in the form of a single drum component or include a plurality of drum components. The rotatable drum 120 defines a generally hollow interior 122 in which a drain cleaning cable or snake 2 is retained or otherwise stored. The tool 110 also comprises an outer housing 130. The housing 130 and the drum 120 generally define a center axis A, a forward end 112 of the tool 110, and a rearward face 114 of the tool. The face 114 is generally oppositely directed from the forward end 112. The drum 120 and other components described herein are rotatable about the axis A. The drum 120 is typically at least partially supported by the housing 130.

The tool 110 also comprises a drive fixture 128 best depicted in FIGS. 15, 16, 19, and 20, for engagement with a rotary power source such as for example a powered drive 124. The tool 110 can be provided with a rotary power source, or be provided without such and subsequently used by engagement with an external rotary power source. It is contemplated that a manual drive could also be used to operate the tool 110.

The tool 110 further comprises a rotatable guide tube 140 which generally extends between the hollow interior 122 defined by the drum 120, and the forward end 112 of the tool. The guide tube 140 is rotatably supported within the tool 110. As will be understood, the drain cleaning cable 2 extends through the guide tube 140. Upon rotation of the drum 120 and upon activation of a cable feed assembly as previously described and schematically shown in FIG. 19 as item 4, cable is either extended from the drum 120, or retracted into the drum 120. The guide tube 140 rotates about axis A at the same rotational speed as the drum 120 when the cable is not being extended or retracted. Linear or axial movement of the cable results in rotation of the guide tube 140 at a different rate of rotation than that of the drum 120.

The tool 110 also comprises a guide tube capture member 144 that is sized, shaped, and configured to receive and/or engage the guide tube 140. Upon rotation of the guide tube 140 about axis A, the guide tube capture member 144 also rotates about axis A.

The tool 110 also comprises a rotatable cam follower 150. The cam follower 150 is coupled with the guide tube capture member 144 such that upon rotation of the guide tube capture member 144 about axis A, the cam follower 150 also rotates about the axis A. In many embodiments, the guide tube capture member 144 couples the follower 150 to the guide tube 140. A cam component 160 is also provided that includes a cam member at which a follower face 152 of the follower 150 generally contacts. The follower 150 is disposed adjacent to the cam component 160. Rotation of the cam follower 150 occurring as a result of drain cleaning cable being extended or retracted from the tool 110, results in axial movement of the cam component 160. The follower face 152 includes (i) one or more projections, lobes, or crests, and (ii) one or more depressions, valleys, or troughs, which upon rotation of the cam 160 causes the cam 160 to move back and forth along axis A in a reciprocating manner. The present subject matter includes providing projections and/or depressions on either contacting face of the cam or follower, and also includes providing such on both faces of the cam and follower.

The tool 110 also comprises an indicator 180 which depending upon the tool configuration, may also constitute or provide the rearward face 114 of the tool 110. The indicator 180 is engaged with or in operable communication with the cam member 160 such that the indicator 180 undergoes axial movement corresponding with axial movement of the cam 160. In certain versions, the tool 110 can utilize an indicator assembly that is in operable communication with the follower component 150 such that upon rotation of the follower component 150, the indicator 180 undergoes axial reciprocal movement. The present subject matter includes other variations.

The tool 110 also comprises one or more biasing members 186 that promote contact and/or operable engagement between the cam 160 and the follower face 152. The biasing members 186 can be in the form of springs such as coil compression spring(s) that urge the cam 160 toward the follower face 152 along axis A. The biasing member(s) can be retained within the tool 110 by one or more plates 185.

The tool 110 can optionally include one or more switches 190 that are in operable engagement or communication with the indicator 180. In many versions, the switch 190 is mounted on or along a rearward region of the tool 110 such that reciprocal axial movement of the indicator 180 or cam 160, causes repeated actuation of the switch 190. As previously described for switch 90, the switch 190 can include a switch actuator 192 and can be in communication with electronics, and/or can include signal means.

A representative operation of the tool 110 is as follows. Upon operation of the powered drive 124, the drum 120 of the tool 110 is rotated about axis A. Rotation of the drum 120 imparts corresponding motion of cable 2 wound and retained within the interior 122 of the drum 120, and for cable disposed along axis A, rotation of that portion of cable about its longitudinal axis, which generally coincides with axis A. As previously described, upon activation of the cable feed assembly 4, rotation of the cable about its axis is translated to axial movement of the cable along its axis.

It is this axial movement of the cable that causes rotation of the guide tube 140 and capture member 144 relative to the drum 120.

Figure 17:
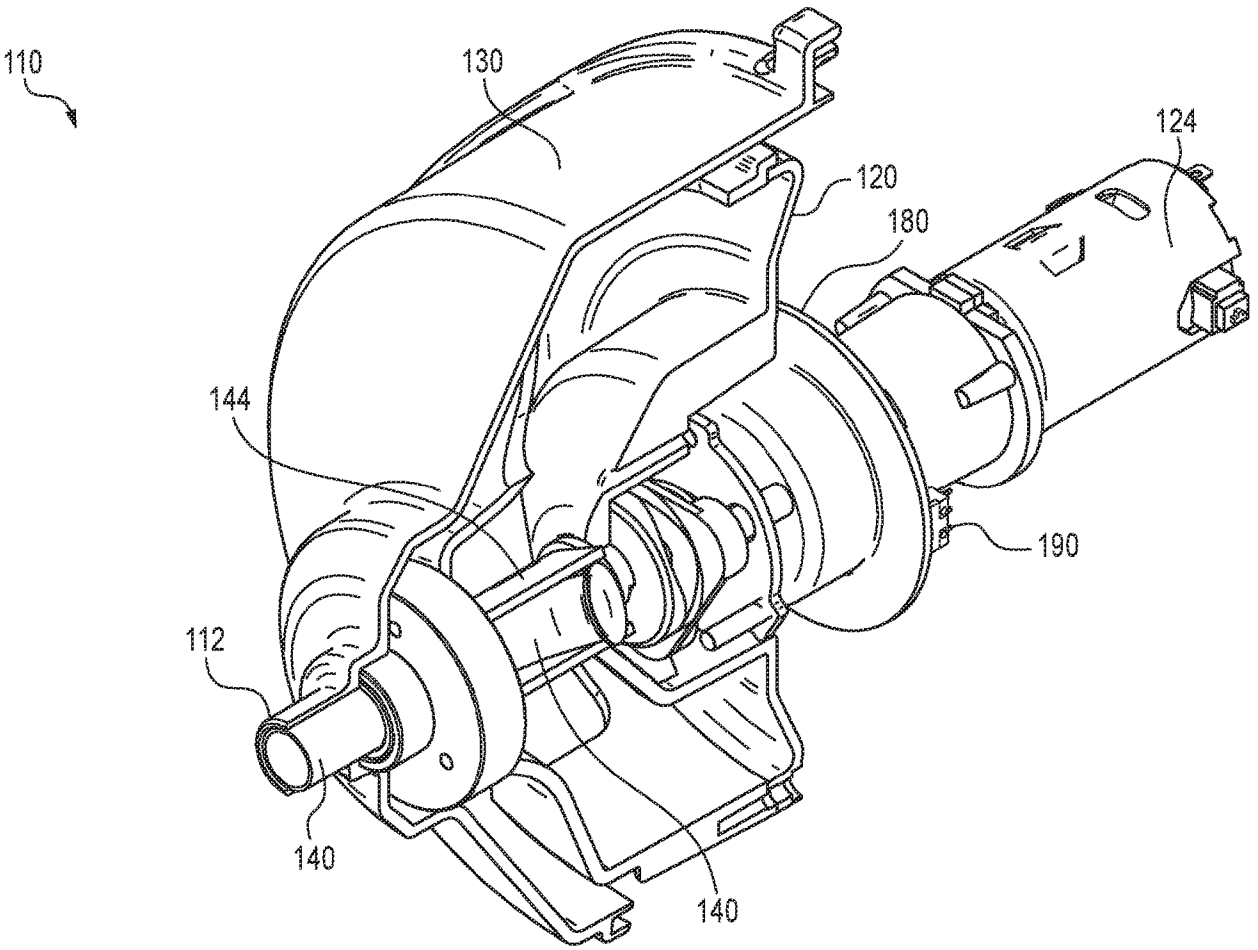
FIGS. 17-19 are additional views of the plumbing tool depicted in FIG. 13 in which the cam component is shown in a crest position.
Figure 18:
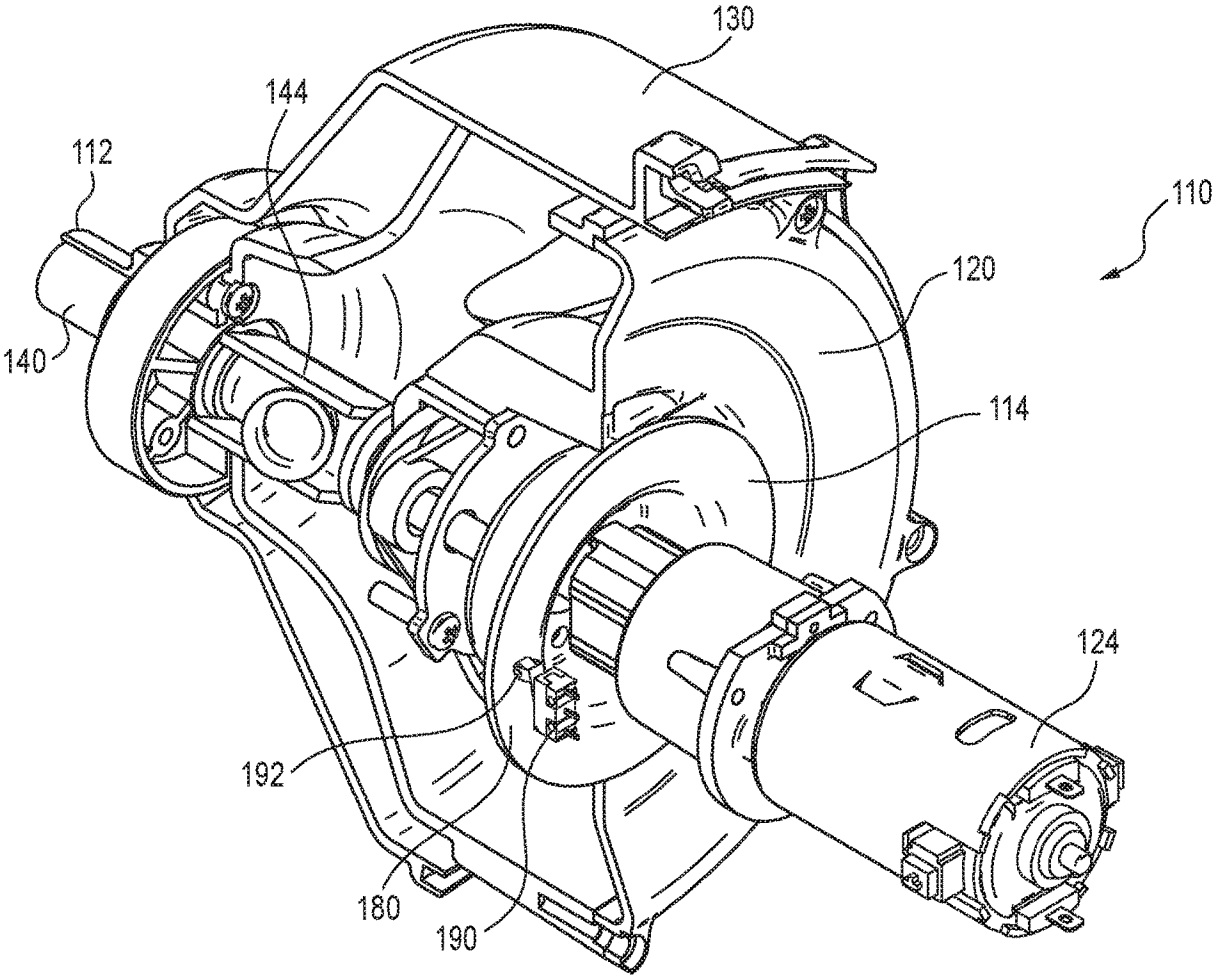
Figure 19:
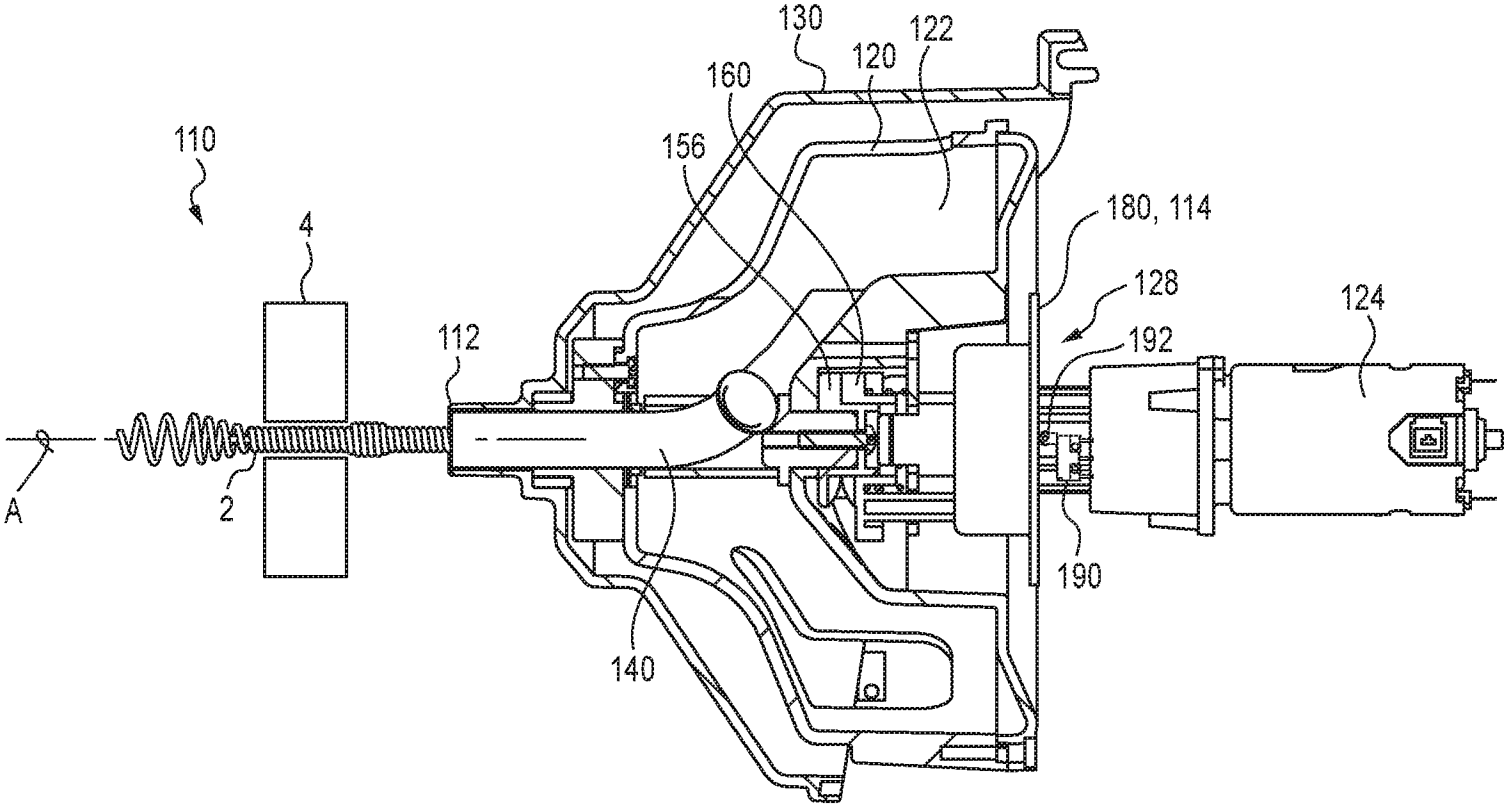
Figure 20:
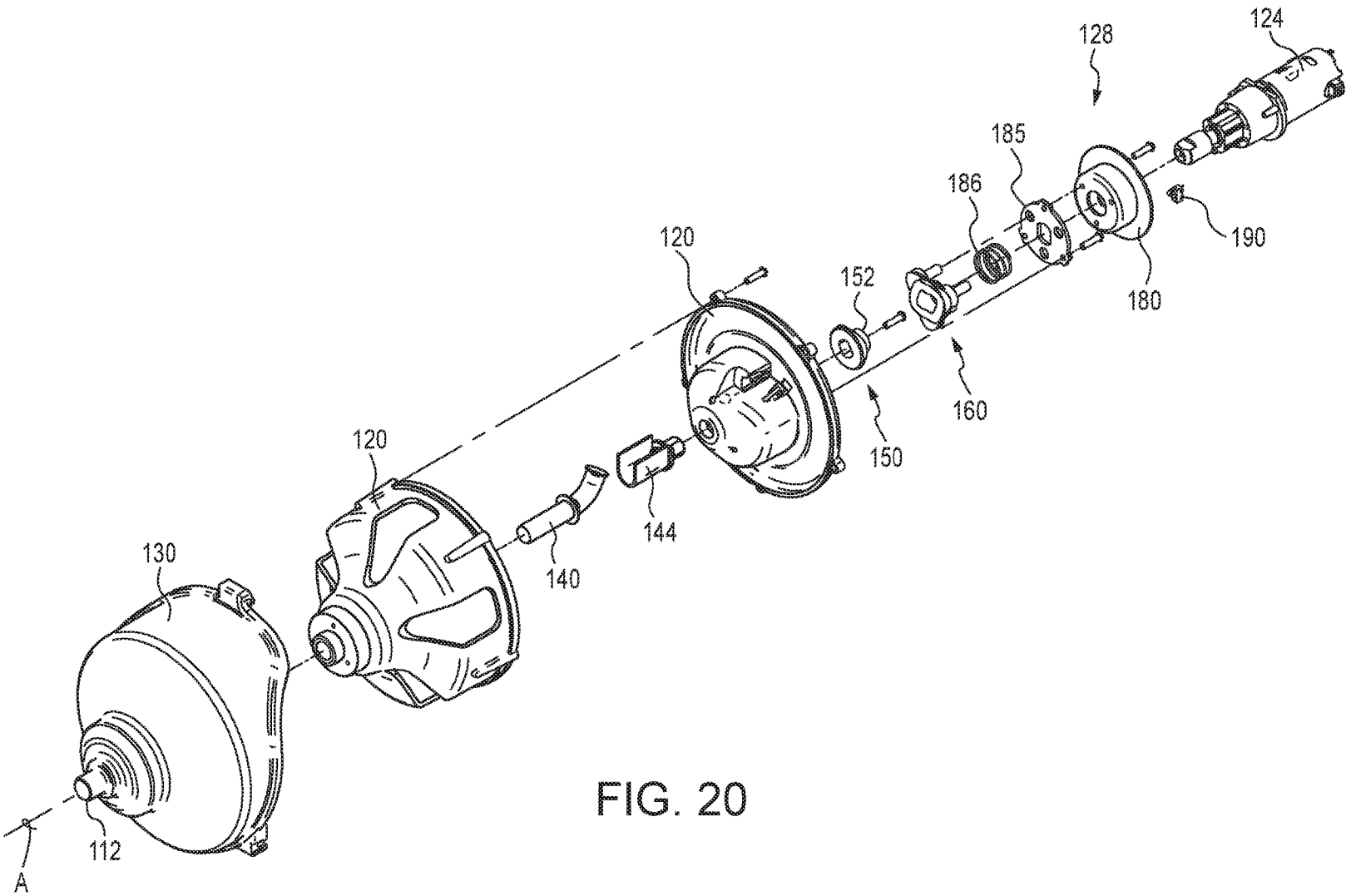
FIG. 20 is an exploded assembly view of the plumbing tool of FIG. 13.
Figure 21:
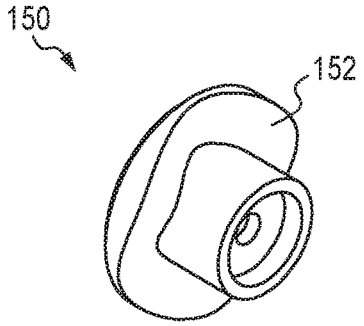
FIG. 21 is a perspective view of an embodiment of a cam follower used in the plumbing tool of FIGS. 13-20.
Figure 22:
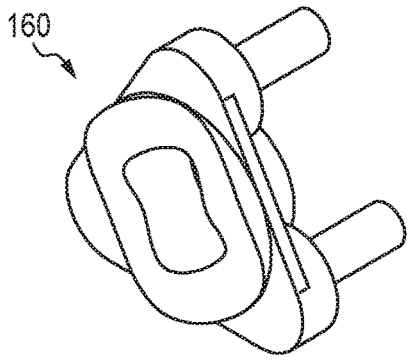
FIG. 22 is a perspective view of an embodiment of a cam component used in the plumbing tool of FIGS. 13-20.

Rotary motion of the guide tube 140 and capture member 144 about axis A is transferred to the follower 150 as a result of coupling between the capture member 144 and the follower 150. Rotation of the cam 160, coupled to the drum 120, relative to the guide tube 140 is translated to reciprocal axial movement of the cam 160 and indicator 180 due to contact between the cam 160 and the follower face 152. FIGS. 17-19 depict a state at which the cam 160 is at a crest position on the follower face 152. That crest position corresponds to full or maximum contact between the switch actuator 192 and the rear face 114 and/or the indicator 180. As will be understood, such contact results in closure of the switch 190 which can provide information or signal(s) to processing electronics. The present subject matter includes other configurations between the switch and the cam.

Figure 23:
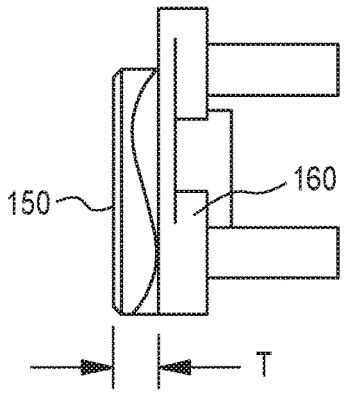
FIG. 23 is a side view showing contact between the cam and follower of FIGS. 21-22 and the cam located in a trough of the follower.
Figure 24:
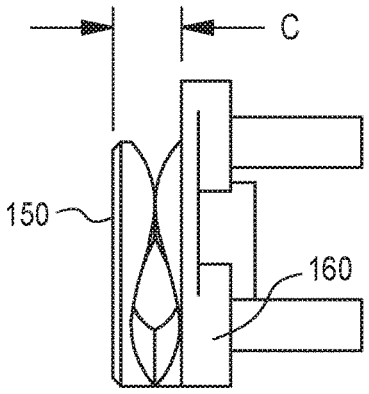
FIG. 24 is a side view showing contact between the cam and follower of FIGS. 21-22 and the cam located on a crest of the follower.

FIGS. 21-24 depict additional aspects of the cam component 160, the cam follower 150, and their engagement. Relative angular displacement of one component to another is translated to reciprocating linear movement of the cam component 160. FIG. 23 depicts a state in which the cam 160 is disposed in a trough or valley defined along the follower 150 and characterized by position T. FIG. 24 shows a state in which the cam 160 is disposed on a crest or peak defined along the follower 150 and characterized by position C. As will be appreciated, upon relative angular displacement of the follower 150 with respect to the cam 160, the cam 160 undergoes reciprocal linear movement between positions T and C.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A plumbing tool comprising:

an outer housing;

a rotatable drum at least partially supported by the housing, the drum defining a hollow interior adapted for retaining a drain cleaning cable;

the outer housing and the drum generally defining a center axis and a forward end of the tool;

a rotatable guide tube rotatably supported within the tool, the guide tube extending between the hollow interior of the drum and the forward end of the tool, the guide tube adapted to receive a drain cleaning cable extending through the guide tube, the guide tube rotates relative to the drum upon axial movement of a drain cleaning cable extending through the guide tube;

a rotatable cam component in operable engagement with the guide tube such that upon rotation of the guide tube relative to the drum, the cam component undergoes axial reciprocal movement;

an indicator in operable communication with the cam component, wherein upon axial reciprocal movement of the cam component, the indicator also undergoes axial reciprocal movement and thereby provides indication of axial cable movement relative to the tool.

2. The tool of claim 1 further comprising:

a follower coupled to the drum, the follower defining a follower face, wherein the cam component is adjacent to the follower and the follower face contacts the cam component.

3. The tool of claim 1 further comprising:

at least one biasing member urging the indicator toward the cam component.

4. The tool of claim 1 further comprising:

a switch assembly including an actuable switch, the switch assembly in operable communication with the indicator.

5. The tool of claim 4 further comprising:

signal means in communication with the switch assembly for providing information concerning actuation of the switch.

6. The tool of claim 1 further comprising:

a cable feed assembly which upon activation, imparts axial movement of a drain cleaning cable extending through the guide tube and undergoing rotation about its axis.

7. The tool of claim 1 further comprising:

a follower coupled to the guide tube, the follower defining a follower face, wherein the cam component is adjacent to the follower and the follower face contacts the cam component.

8. The tool of claim 7 further comprising:

a guide tube capture member that couples the follower to the guide tube.

9. A plumbing tool comprising:

an outer housing;

a rotatable drum at least partially supported by the housing, the drum defining a hollow interior adapted for retaining a drain cleaning cable;

the outer housing and the drum generally defining a center axis and a forward end of the tool;

a rotatable guide tube rotatably supported within the tool, the guide tube extending between the hollow interior of the drum and the forward end of the tool, the guide tube adapted to receive a drain cleaning cable extending through the guide tube, the guide tube rotates relative to the drum upon axial movement of a drain cleaning cable extending through the guide tube;

a follower coupled to the drum, the follower defining a follower face, a rotatable cam component in operable engagement with the guide tube such that upon rotation of the guide tube relative to the drum, the cam component rotates and undergoes axial reciprocal movement, the cam component is adjacent to the follower and the follower face contacts the cam component;

an indicator in operable communication with the cam component, wherein upon axial reciprocal movement of the cam component, the indicator also undergoes axial reciprocal movement and thereby provides indication of axial cable movement relative to the tool.

10. The tool of claim 9 further comprising:

at least one biasing member urging the indicator toward the cam component.

11. The tool of claim 9 further comprising:

a switch assembly including an actuable switch, the switch assembly in operable communication with the indicator.

12. The tool of claim 11 further comprising:

signal means in communication with the switch assembly for providing information concerning actuation of the switch.

13. The tool of claim 9 further comprising:

a cable feed assembly which upon activation, imparts axial movement of a drain cleaning cable extending through the guide tube and undergoing rotation about its axis.

14. A plumbing tool comprising:

an outer housing;

a rotatable drum at least partially supported by the housing, the drum defining a hollow interior adapted for retaining a drain cleaning cable;

the outer housing and the drum generally defining a center axis and a forward end of the tool;

a rotatable guide tube rotatably supported within the tool, the guide tube extending between the hollow interior of the drum and the forward end of the tool, the guide tube adapted to receive a drain cleaning cable extending through the guide tube, the guide tube rotates relative to the drum upon axial movement of a drain cleaning cable extending through the guide tube;

a follower coupled to the guide tube, the follower defining a follower face;

a rotatable cam component in operable engagement with the follower such that upon rotation of the follower relative to the drum, the cam component undergoes axial reciprocal movement, the cam component is adjacent to the follower and the follower face contacts the cam component;

an indicator in operable communication with the cam component, wherein upon axial reciprocal movement of the cam component, the indicator also undergoes axial reciprocal movement and thereby provides indication of axial cable movement relative to the tool.

15. The tool of claim 14 further comprising:

a guide tube capture member that couples the follower to the guide tube.

16. The tool of claim 14 further comprising:

at least one biasing member urging the indicator toward the cam component.

17. The tool of claim 14 further comprising:

a switch assembly including an actuable switch, the switch assembly in operable communication with the indicator.

18. The tool of claim 17 further comprising:

signal means in communication with the switch assembly for providing information concerning actuation of the switch.

19. The tool of claim 14 further comprising:

a cable feed assembly which upon activation, imparts axial movement of a drain cleaning cable extending through the guide tube and undergoing rotation about its axis.

* * * * *